United States Patent [19]

Masui

[11] 4,150,641

[45] Apr. 24, 1979

[54] ARRANGEMENT FOR CONTROLLING AN AIR-FUEL RATIO OF AN AIR-FUEL MIXTURE OF AN INTERNAL COMBUSTION ENGINE

[75] Inventor: Takatoshi Masui, Susono, Japan

[73] Assignee: Toyota Jidosha Kogyo Kabushiki Kaisha, Toyota, Japan

[21] Appl. No.: 816,077

[22] Filed: Jul. 15, 1977

[30] Foreign Application Priority Data

Feb. 28, 1977 [JP] Japan ..... 52-20178

[51] Int. Cl.[2] ..... F02B 33/00

[52] U.S. Cl. ..... 123/119 EC; 261/DIG. 69

[58] Field of Search ..... 123/119 EC; 261/DIG. 69, 121 B, DIG. 74

[56] References Cited

U.S. PATENT DOCUMENTS

| | | | |
|---|---|---|---|
| 3,556,063 | 1/1971 | Tuzson | 261/DIG. 69 |
| 3,672,339 | 6/1972 | Lazar | 261/DIG. 69 |
| 3,687,121 | 8/1972 | Tuzson | 261/DIG. 69 |
| 3,690,305 | 9/1972 | Shinado et al. | 123/119 EC |
| 3,906,910 | 9/1915 | Szlaga, Jr. | 123/119 EC |
| 3,942,493 | 3/1976 | Linder et al. | 123/119 EC |

*Primary Examiner*—Charles J. Myhre
*Assistant Examiner*—Raymond A. Nelli
*Attorney, Agent, or Firm*—Stevens, Davis, Miller & Mosher

[57] ABSTRACT

An arrangement for controlling the air-fuel ratio of an air-fuel mixture to be supplied to an internal combustion engine is disclosed. In the arrangement a fluidic element or fluidic elements, performing high frequency on-off control action, are arranged in feedback control circuits for regulating the amount of flow of air or fuel to be supplied into an engine carburetor, thereby adjusting the air-fuel ratio to the level of the stoichiometric air-fuel ratio.

6 Claims, 4 Drawing Figures

ARRANGEMENT FOR CONTROLLING AN AIR-FUEL RATIO OF AN AIR-FUEL MIXTURE OF AN INTERNAL COMBUSTION ENGINE

FIELD OF THE INVENTION

The present invention relates to the arrangement for controlling an air-fuel ratio of an air-fuel mixture to be supplied into an internal combustion engine. More particularly the present invention relates to a feedback control arrangement in which a fluidic element or fluidic elements, capable of performing an on-off control action at a high frequency, are provided in a feedback control circuit to regulate the amount of air or fuel fed to an engine carburetor, thereby adjusting the air-fuel ratio of the air-fuel mixture to the level of a stoichiometric air-fuel ratio. An internal combustion engine with this control arrangement is able to promote the performance of a known three way catalytic converter, provided in an exhaust system of the engine for the purpose of cleaning the engine exhaust emissions.

BACKGROUND OF THE INVENTION

To satisfy the recent requirement for cleaning emissions from an automobile engine, there has been provided a method of employing a three way catalytic convertor, which operates to eliminate harmful emission components in an exhaust emission from the automobile engine. However, when the three way catalytic convertor is employed, it is necessary for the air-fuel ratio of the air-fuel mixture burning in an automobile engine to be adjusted to the stoichiometric air-fuel ratio so as to enhance the catalytic action of the three way catalytic convertor. For this reason, an arrangement for providing a feedback control for controlling the air-fuel ratio has conventionally been proposed, so as to adjust the air-fuel ratio of the air-fuel mixture to the stoichiometric air-fuel ratio before the air-fuel mixture is fed into combustion chambers of an automobile engine. In the conventional arrangement, a feedback control circuit, for controlling the air-fuel ratio, is formed in such a manner that an electro-magnetic valve is disposed in a fuel passageway or in an air-bleed passageway of an engine carburetor, so that the amount of fuel or air fed into the engine is regulated by the on-off control operation performed by the valve. Also, an exhaust gas sensor, which is able to detect the concentration of a particular gas component in the exhaust gas, is disposed in the feedback control circuit of the conventional arrangement for controlling the actuation of the electro-magnetic valve, via a computer unit. The employment of the electro-magnetic valve is quite conventional for regulating the amount of fuel or air, however, the regulation by the on-off control operation of the electro-hydraulic valve usually causes a fluctuation of the flow of the fuel or air. Therefore, it is often difficult to precisely adjust the air-fuel ratio of the air-fuel mixture to the stoichiometric air-fuel ratio before the mixture is fed into combustion chambers of an engine. This difficulty can be overcome if the frequency of the on-off control operation of the electro-magnetic valve is high enough to reduce the generation of the fluctuation of the flow of the fuel or air. However, since the electro-magnetic valve always employs a movable valve element having a considerable amount of inertia, it is impossible to sufficiently increase the frequency of the on-off action of the electro-magnetic valve. Further, when the wear of the valve seat, sliding portions or mechanical contacting portions of the electro-magnetic valve, as well as the durability of spring elements employed in the valve, are taken into consideration, it is also impossible to increase the frequency of the on-off control action of the electro-magnetic valve to more than a certain limited frequency level. Thus, so long as an electro-magnetic valve is employed in the feedback control circuit for regulating the amount of the flow of air or fuel, it is difficult to precisely adjust the air-fuel ratio of an air-fuel mixture to the stoichiometric air-fuel ratio.

Therefore, an object of the present invention is to provide an arrangement for controlling an air-fuel ratio of an air-fuel mixture supplied to an internal combustion engine, whereby the difficulties encountered by the conventional arrangement for controlling an air-fuel ratio of an air-fuel mixture is well eliminated.

Another object of the present invention is to provide an arrangement for controlling an air-fuel ratio of an air-fuel mixture supplied to an internal combustion engine, in which arrangement the on-off control of the flow of air or fuel is performed at a frequency which is high enough to provide a substantially continuous flow of air or fuel, without causing any fluctuation during the controlling of the air-fuel ratio of an air-fuel mixture supplied to an automobile engine.

A further object of the present invention is to provide an arrangement for controlling an air-fuel ratio of an air-fuel mixture supplied into an internal combustion engine in which no feedback control element that may cause the wear problem is used, so as to ensure that the arrangement has a long durability.

In accordance with the present invention, the fluidic element employed in the arrangement of the present invention is not provided with any movable part therein. Therefore, deterioration of the fluidic element due to wear of the element does not take place. Consequently the employment of the fluidic element of the present invention results in the present invention being less susceptible to damage than the heretofore proposed air-fuel ratio control arrangement. Further, application of a small signal flow of fluid to the fluidic element enables the element to control the flow of air or fuel and additionally, the response speed of the fluidic element reaches a high frequency of several hundred hertz. As a result, it is possible to prevent the flow of air or fuel from fluctuating during the controlling of the air-fuel ratio of an air-fuel mixture.

Further objects and advantages of the present invention will become aparent from the description of embodiments with reference to the drawings wherein.

DESCRIPTION OF PREFERRED EMBODIMENT

Figure 1:
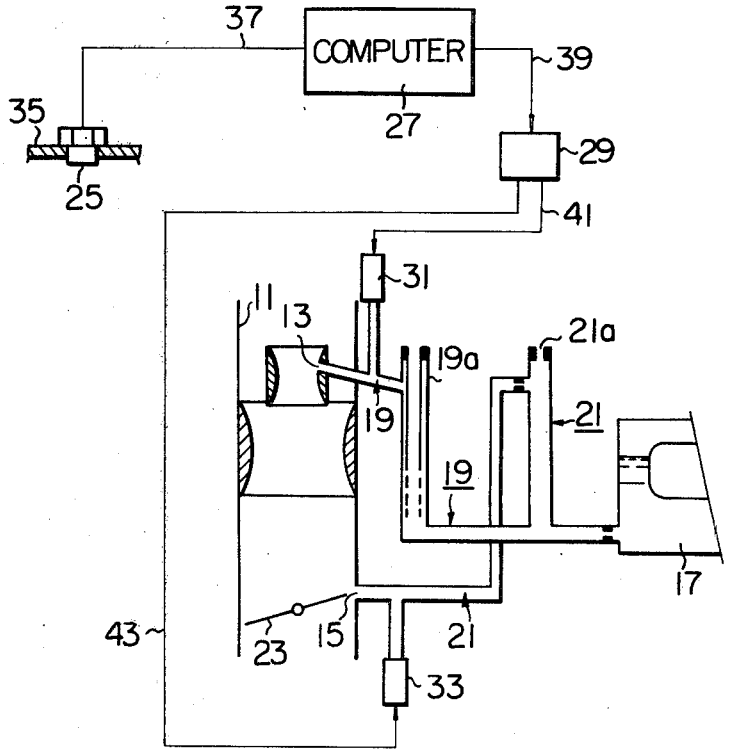
FIG. 1 is a block diagram of a basic arrangement for controlling an air-fuel ratio of an air-fuel mixture according to the present invention.

Referring now to FIG. 1, reference numeral 11 represents an air horn of a carburetor, and a main nozzle 13 is exposed to a venturi portion of the air horn 11. Fuel fed from a float chamber 17, throgh a fuel passage 19 of a main fuel supply system, and mixed with air at a main air bleed well 19*a*, reaches the main nozzle 13 and is injected into the air horn 11 by a stream of air flowing in the venturi portion to produce an air-fuel mixture to be supplied to an engine. Separately, fuel fed from the float chamber 17, through a fuel passage 21 of a low-speed fuel supply system, and mixed with air at an air bleed pipe 21*a* of the slow speed system, is supplied to an intake manifold (not shown) via a slow port 15 of a throttle valve 23 as the air-fuel mixture for slow speed operation of the engine. Reference numeral 25 represents a known oxygen sensor or lambda sensor mounted on an exhaust pipe 35 of the internal combustion engine. The sensor 25 senses the oxygen gas concentration in the exhaust gas, and detects the difference between the stoichiometric air-fuel ratio of the air-fuel mixture in the internal combustion engine and the actual air-fuel ratio of the air-fuel mixture fed to the engine, and generates an electric output signal corresponding to the actual air-fuel ratio of the air-fuel mixture fed to the engine through the detected value as a medium. The lambda sensor 25 may be disposed on the suction pipe as required. This lambda sensor 25 is connected to a computer 27 through a signal line 37. From this computer 27 a control signal is transmitted to an electricity-fluid signal converter 29 through a signal line 39 depending on the level of the signal imparted to the computer 27 from the signal line 37. Further, from the electricity-fluid signal converter 29, a control signal is transmitted through a signal line 41 (a passage of signal fluid) to a fluidic element 31 disposed in the fuel passage connected to the main nozzle 13.

Another control signal is transmitted through a signal line 43 (a passage of signal fluid) to a fluidic element 33 disposed in the fuel passage connected to the slow port 15. The fluidic element 31 acts as an on-off control element for regulating the amount of the air bleed incorporated in the fuel flowing in the main nozzle 13, in response to the control signal of the electricity-fluid signal converter 29, while the throttle valve 23 is opened and the main nozzle 13 is operated. The other fluidic element 33 acts as an on-off control element for regulating the amount of the air bleed incorporated into the fuel injected from the slow port 15, in response to the control signal of the electricity-fluid signal converter 29, while the throttle valve 23 is substantially closed and the slow port 15 is operated. More specifically, when the air-fuel ratio of the air-fuel mixture in the engine, detected by the lambda sensor, is varied depending on the stoichiometric air-fuel ratio, the amount of the air bleed in the main fuel supply system or low-speed fuel supply system is controlled by the fluidic element 31 or 33; and, there is established a feedback control system for adjusting the varied air-fuel ratio of the air-fuel mixture supplied to the engine to the stoichiometric air-fuel ratio. As will be apparent from the foregoing described arrangement, according to the present invention, by employing fluidic elements 31 and 33 for the feedback control system, a movable control element having a large amount of inertia, which has heretofore been used for the conventional air-fuel ratio control arrangement, can be completely eliminated. In the above-illustrated arrangement, it is preferred that the computer 27 and the electricity-fluid signal converter 29 be attached to the body side of a vehicle through an appropriate shock-absorbing member so that they can resist vibrations caused by operation of the internal combustion engine or vibrations imposed on the vehicle from the road. Further, in order to maintain good responsiveness in the operation of controlling the air-fuel ratio, it is preferred that the fluidic elements 31 and 33 be disposed in the vicinity of the carburetor.

A specific embodiment of the air-fuel ratio control arrangement for an internal combustion engine according to the present invention, which has hereinbefore illustrated by reference to FIG. 1, will now be described with reference to FIG. 2. In the embodiment shown in FIG. 2, an electro-magnetic flapper device 29*a* is used as the electricity-fluid signal converter 29 shown in FIG. 1. In each of the fluidic elements 31 and 33, there is adopted a structure in which air for controlling the air-fuel ratio is fed from an air cleaner (not shown) through an air pump 45. More specifically, air fed from the air pump 45 is introduced into air inlet ports 31*a* and 33*a*, of the fluidic elements 31 and 33, through appropriate air pipe passages 47 and 49. Further, air fed out of the air pump 45 is passed through an orifice 51 to form a control air stream and it is fed to control input ports 31*d* and 33*d*, of the fluidic elements 31 and 33, through control pipe passages 41 and 43. At this stage, if a control port 53, communicated with the control pipe passages 41 and 43, is closed by the electromagnetic flapper 29*a*, the control air stream flows into the control input ports 31*d* and 33*d*, of the fluidic elements 31 and 33, through the control pipe passages 41 and 43. Further, if the control port 53' is opened by the electromagnetic flapper 29*a*, the control air stream leaks from the control port 53' and the amount of the control air stream flown into the control input ports 31*d* and 33*d* is reduced. Accordingly, for example, in the fluidic element 31 of the main fuel supply system, when the control port 53' is opened, since the amount of the control air stream at the control input port 31*d* is reduced, air which has flowed into the air port 31*a* passes through a first flow-out port 31*b* and flows into the fuel passage 19 of the main fuel supply system to increase the amount of the air bleed to the fuel injected from the main nozzle 13. When the control port 53' is closed, since the amount of the control air stream at the control input port 31*d* is increased, air which has flowed into the air port 31*a* passes through a second flow-out port 31*c* and flows into the fuel passage 19 of the main fuel supply system through the orifice 53. Accordingly, the amount of the air bleed to the fuel injected from the main nozzle 13 is maintained at a relatively low level. Similar operations are conducted also in the fluidic element 33 of the low-speed fuel supply system. Incidentally, since the inertia of the flapper portion of the electromagnetic flapper 29*a* is very small, the opening-closing control of the control port 53' can be performed by a signal of very high frequency, such as several hundred hertz. Hence, in the fluidic elements 31 and 33, the amount of the air bleed can be controlled at a high frequency in conformity with the closing-opening control action of the electromagnetic flapper 29*a*. A piezo-electric element may be used instead of the above-mentioned electromagnetic flapper 29*a*. More specifically, there may be adopted a known construction in which piezo-electric elements are mounted on the side walls of the fluidic elements 31 and 33 and the flow direction of the air stream in the fluidic element 31 or 33 is changed over between the first flow-out port 31*b* or 33*b* and the second flow-out port 31*c* or 33*c*, by directly controlling energization and de-energization of the piezo-electric elements. When piezo-electric elements are thus employed in the air-fuel ratio control arrangement of the present invention, there can be attained an advantage that the effect of eliminating movable elements from the feedback control circuit by using fluidic elements can be further enhanced.

Figure 2:
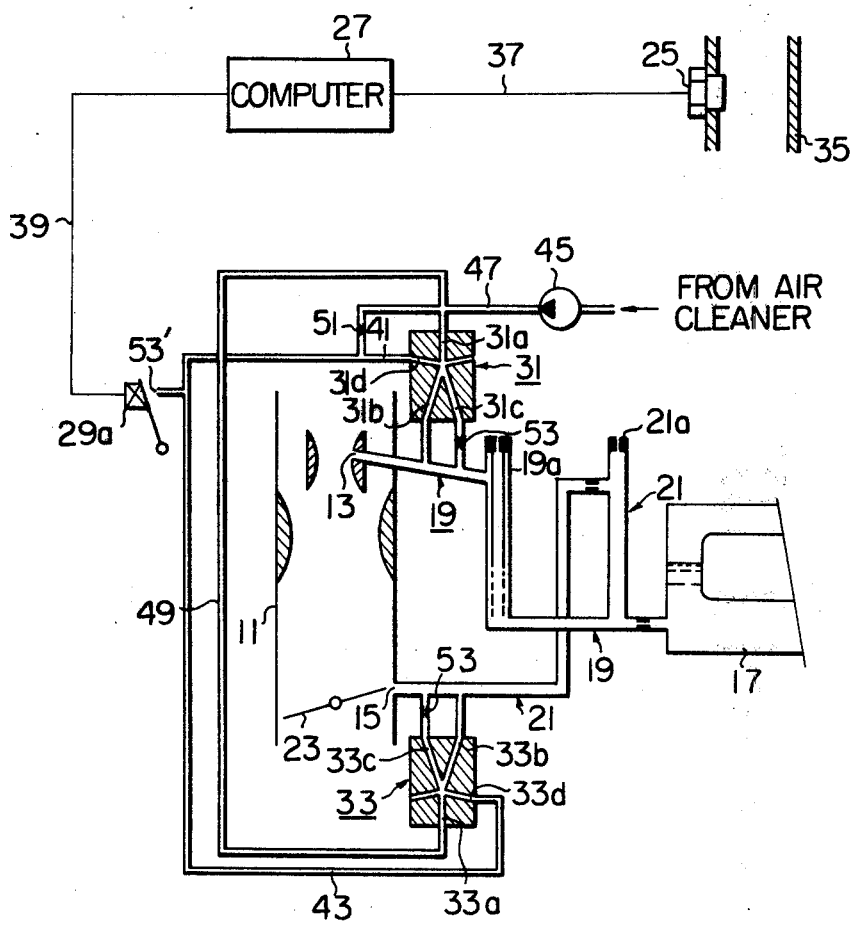
FIG. 2 is a block diagram illustrating an embodiment of the present invention.
Figure 3:
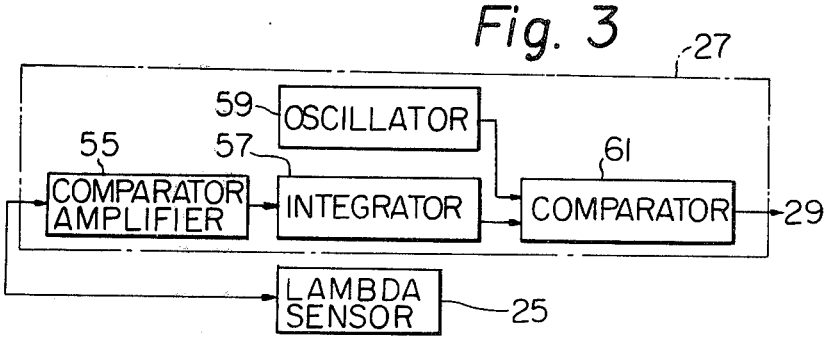
FIG. 3 is a block diagram illustrating a typical example of a computer unit employed for the arrangement of the present invention.

An embodiment of the structure of the computer 27 to be used for the air-fuel ratio control arrangement for an internal combustion engine according to the present invention, which is illustrated in FIGS. 1 and 2, will now be described with reference to the block diagram of FIG. 3. The construction of the computer 27 shown in the block diagram of FIG. 3 is a typical example of the construction of a computor for use in feedback control of the operation of an internal combustion engine. For convenience, in FIG. 3 there is shown a system connected to the lambda sensor 25 to generate output signals for controlling and actuating an electricity-fluid signal converter 29, such as an electromagnetic flapper 29*a* or piezo-electric element, in response to the air-fuel ratio detecting signal of the lambda sensor 25.

This computor 27 comprises: a comparator amplifier 55 into which an on-off output signal generated by the lambda sensor 25 in response to a signal of the air-fuel ratio of the air-fuel mixture, is imparted; an integrator 57, for integrating the output signal of the comparator amplifier 55; and, a comparator 61, for comparing the output signal of the integrator 57 with an oscillating output of a selected frequency transmitted from an oscillator 59 and generating on-off signals of a constant frequency but varying in time ratio. The on-off signals generated from this comparator 61 are utilized for controlling and operating the above-mentioned electricity-fluid signal converter 29. The on-off frequency of the on-off signals of the comparator 61 is the same as the frequency of the oscillating signal generated by the oscillator 59. Accordingly, if the oscillating frequency of the oscillator 59 is set at a high frequency level, the computer 27 generates an on-off control signal of a high frequency, in response to the air-fuel ratio detecting signal of the lambda sensor 25, and the electricity-fluid signal converter 29 can be operated at a high frequency. Accordingly, as will be apparent from the block diagrams of FIGS. 1 and 2, illustrating the air-fuel ratio control arrangement of the present invention, the fluidic elements 31 and 33 can regulate the flow of the air bleed at a high frequency.

Figure 4:
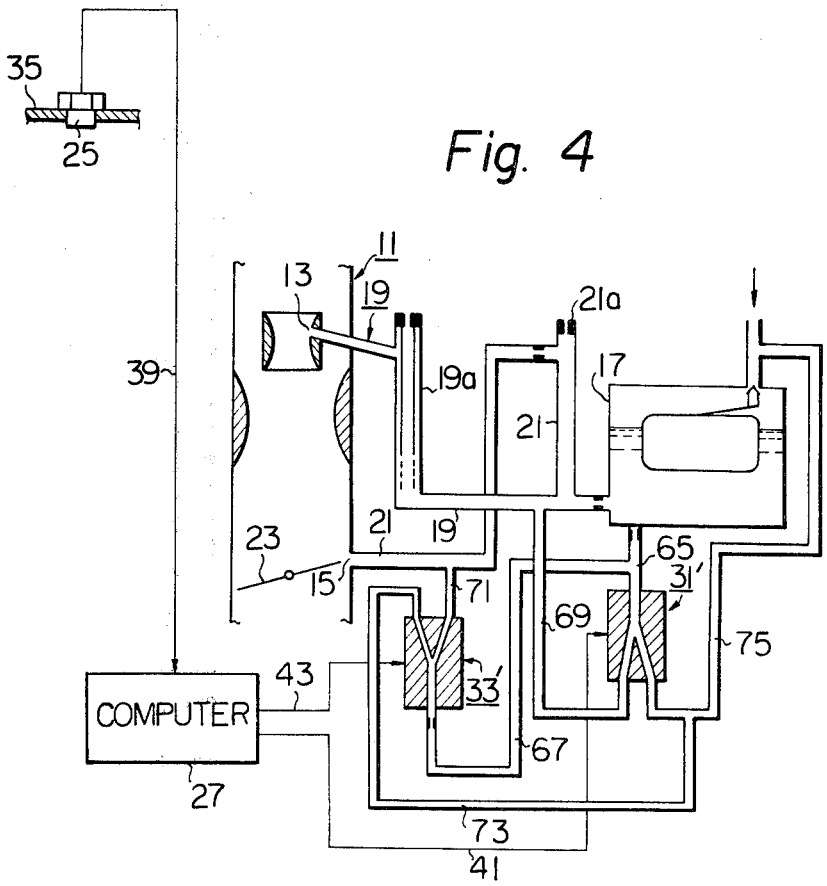
FIG. 4 is a block diagram illustrating another embodiment of the present invention in which a feedback control system for regulating the amount of flow of the fuel is provided.

In the embodiment of the air-fuel ratio control arrangement according to the present invention, which is illustrated in FIG. 2 the amount of the air bleed is adjusted by on-off control operations of fluidic elements so that the air-fuel ratio in the air-fuel mixture supplied to the engine is adjusted to the stoichiometric air-fuel ratio. Another embodiment of the air-fuel ratio control arrangement for an internal combustion engine according to the present invention, in which there is provided a feedback control circuit for performing the on-off control of the flow of fuel by fluidic elements, will now be described by reference to a block diagram of FIG. 4. In the embodiment shown in FIG. 4, the same members and elements as those of the air-fuel control arrangement shown in FIGS. 1 and 2 are represented by the same reference numerals as used in FIGS. 1 and 2. Only elements important for the control of the air-fuel ratio in this embodiment will now be described. Referring now to FIG. 4, a fuel passage 19 of the main fuel supply system is arranged so that fuel for the air-fuel ratio control flows from a fluidic element 31' through a fuel passage 69, and a fuel passage 21 of the low-speed fuel supply system is arranged so that fuel for the air-fuel ratio control is flown from a fluidic element 33' through a fuel passage 71. The fuel for the air-fuel ratio control flows into the above two fluidic elements 31' and 33' from a float chamber 17 through fuel passages 65 and 67. When the proportion of the fuel is increased in response to the on-off signals of the computer 27, fed through signal lines 41 and 43, so as to adjust the air-fuel ratio in the air-fuel mixture supplied to the engine to the stoichiometric air-fuel ratio, as pointed out hereinbefore, the fuel for the air-fuel ratio control is fed out of the fluidic elements 31' and 33' to the fuel passages 69 and 71. When the proportion of the fuel is decreased, so as to adjust the air-fuel ratio in the air-fuel mixture supplied to the engine to the stoichiometric air-fuel ratio, the fuel for the air-fuel ratio control, which flows into the fluidic elements 31' and 33' from the float chamber 17, is fed back to the float chamber 17 through fuel passages 73 and 75. In this embodiment, change-over of the fuel stream in the fluidic elements 31' and 33' may be accomplished by utilizing the electric conductivity possessed by a fuel for an internal combustion engine according to, for example, a method disclosed by the applicant in Japanese Utility Model Publication No. 23826/76 or methods disclosed in the specifications of the U.S. Pat. Nos. 3,266,511 and 3,071,154. More specifically, a pair of electrodes and a magnet device are provided for the fluidic elements 31' and 33', and a controlling current is supplied to the electrodes from the computor 27 through signal lines 41 and 43; and, the direction of flow of the electrically conductive fuel is changed over by an electromagnetic force generated by the mutual action of the electric current and magnetic field. Also, in this embodiment of the air-fuel ratio control arrangement for an internal combustion engine according to the present invention, in which the flow rate of the fuel is regulated by the fluidic elements 31' and 33' shown in FIG. 4, so as to adjust the air-fuel ratio in the air-fuel mixture supplied to the engine, no movable element is used. Therefore, the effect of the present invention, namely the effect of performing the feedback control of the air-fuel ratio by high-frequency on-off operations, can be fully maintained.

As will be apparent from the foregoing illustration, in the air-fuel ratio control arrangement for an internal combustion engine according to the present invention, as soon as it is detected that the air-fuel ratio in the air-fuel mixture supplied to the engine deviates from the stoichiometric air-fuel ratio, the flow rate of the fuel or air bleed is regulated and controlled by fluidic elements at high frequency and the feedback control is accomplished, so that the air-fuel ratio is adjusted to the stoichiometric air-fuel ratio. At this stage, generation of fluctuation, which is readily caused in a fuel stream, can be prevented because the controlling frequency is very high. Further, since fluidic elements free of movable elements are employed, the problem of reduction of the durability of the air-fuel control arrangement, by wearing or damage of control elements, can be effectively solved. Thus, it will readily be understood that a very excellent air-fuel ratio control arrangement for an internal combustion engine can be provided according to the present invention.

What is claimed is:

1. An arrangement for controlling the air-fuel ratio of an air-fuel mixture to be supplied to an internal combustion engine from a carburetor via an intake manifold, comprising:

a first means for producing a signal indicative of a change in the air-fuel ratio of the air-fuel mixture;

a second means for producing an on-off control signal of high frequency from the signal from the first means; and two fluidic elements performing regulation of the amount of flow of one of an air bleed and fuel, which are supplied to the carburetor of the engine, at a high frequency corresponding to the frequency of the on-off control signal of said second means, thereby adjusting the air-fuel ratio of the air-fuel mixture to the stoichiometric air-fuel ratio, one of said fluidic elements being arranged in a main fuel supply system of the engine and the other of said fluidic elements being arranged in a low-speed fuel supply system of the engine.

2. An arrangement for controlling the air-fuel ratio as set forth in claim 1, wherein said first means comprise a gas sensor sensing the concentration of a specified gas component in emissions from the engine and producing an electrical signal indicative of a change in the air-fuel ratio, and said second means comprise a computer unit connected to said gas sensor for producing an electric on-off control signal of high frequency, and an actuating means for actuating the regulation of said fluidic elements in response to said electric on-off control signal from said computer unit.

3. An arrangement for controlling the air-fuel ratio as set forth in claim 2, wherein said actuating means comprises an electro-magnetic flapper device having an electro-magnetically operated flapper, and a control port which is opened and closed by said flapper, said electro-magnetic flapper device being associated with said fluidic elements so that opening and closing of said control port of said device causes said regulation of said fluidic elements.

4. An arrangement for controlling the air-fuel ratio of an air-fuel mixture to be supplied to an internal combustion engine from a carburetor via an intake manifold, comprising:

a lambda sensor arranged in an exhaust pipe of the engine for producing an electric signal indicative of the actual air-fuel ratio of the air-fuel mixture to be supplied to the engine;

a computer unit for producing an electric on-off control signal of high frequency from the electric signal of the lambda sensor, the electric on-off control signal being indicative of a deviation of the actual air-fuel ratio from the stoichiometric air fuel ratio;

an electro-magnetic flapper device electrically connected to said computer unit, said device having a flapper which is electro-magnetically operated in response to the electric on-off control signal from said computer unit, and a control port connected to an air pump by means of an air pipe, the flapper operating to open and close the control port; and, first and second fluidic elements for regulating the amount of air bleed supplied to a main fuel supply system and a low-speed fuel supply system of the engine, respectively, each of said fluidic elements having an air inlet port connected to the air pump, a control-air input port connected to the air pump via an orifice, and first and second air output ports connected to the fuel passage respectively, the first air outlet port of each of said first and second fluidic elements having an orifice therein.

5. An arrangement for controlling the air-fuel ratio of an air-fuel mixture to be supplied to an internal combustion engine from a carburetor via an intake manifold, comprising:

a lambda sensor arranged in an exhaust pipe of the engine for producing an electric signal indicative of the actual air-fuel ratio of the air-fuel mixture to be supplied to the engine;

a computer unit for producing an electric on-off control signal of high frequency from the electric signal of the lambda sensor, the electric on-off control signal being indicative of a deviation of the actual air-fuel ratio from the stoichiometric air-fuel ratio;

first and second fluidic elements for regulating the amount of fuel to be additionally supplied into a main fuel supply system and low-speed fuel supply system of the engine, respectively, each of said fluidic elements having a fuel inlet port fluidly connected to a fuel float chamber of the engine, a first fuel outlet port for passing the fuel from the fuel inlet port to the related fuel supply system, and a second fuel outlet port for passing the fuel from the fuel inlet port to said fuel float chamber via a fuel return pipe; and, means for electro-magnetically actuating said regulation of said first and second fluidic elements upon receipt of said electric on-off control signal of high frequency.

6. An arrangement for controlling the air-fuel ratio as set forth in claim 5, wherein said electro-magnetic actuating means comprise magnet elements always forming a predetermined magnetic field around said first and second fluidic elements, and a pair of electrodes mounted on each of said first and second fluidic elements, and electrically connected to said computer unit, said pair of electrodes cooperating with said magnet elements for generating an electro-magnetic force applied to said first and second fluidic elements, upon receipt of the electric on-off control signal from said computer unit.

* * * * *